US006440555B1

(12) United States Patent
Yuuki et al.

(10) Patent No.: US 6,440,555 B1
(45) Date of Patent: Aug. 27, 2002

(54) PACKAGE FOR TAKING UP FALSE TWIST YARNS

(75) Inventors: Yasunori Yuuki, Kawanishi; Shoichi Akita, Kyoto, both of (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/913,023

(22) PCT Filed: Feb. 10, 2000

(86) PCT No.: PCT/JP00/00765

§ 371 (c)(1),
(2), (4) Date: Aug. 9, 2001

(87) PCT Pub. No.: WO00/47507

PCT Pub. Date: Aug. 17, 2000

(30) Foreign Application Priority Data

Feb. 10, 1999 (JP) ..... 11-033226

(51) Int. Cl.[7] ..... D01F 6/00

(52) U.S. Cl. ..... 428/364; 428/395; 57/208; 57/206; 57/245; 57/246; 206/392

(58) Field of Search ..... 428/364, 395; 57/208, 206, 245, 246; 206/392

(56) References Cited

U.S. PATENT DOCUMENTS

| | | | | |
|---|---|---|---|---|
| 3,822,334 A | | 7/1974 | Patterson | |
| 4,002,427 A | | 1/1977 | Möller et al. | 8/155.1 |
| 6,306,498 B1 | * | 10/2001 | Yuuki et al. | 428/364 |
| 6,306,499 B1 | * | 10/2001 | Ochi et al. | 428/395 |
| 6,333,106 B2 | * | 12/2001 | Howell et al. | 428/364 |

FOREIGN PATENT DOCUMENTS

| | | | |
|---|---|---|---|
| JP | 57-29621 | | 2/1982 |
| JP | 61211277 | | 9/1986 |
| JP | 62004177 | | 1/1987 |
| JP | 63056151 | | 3/1988 |
| JP | 9-78373 | | 3/1997 |
| JP | 11302932 A | * | 11/1999 |
| JP | 2001348740 A | * | 12/2001 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention provides a package, of a false twist yarn composed of polytrimethylene terephthalate fibers, characterized in that a hardness and a winding density of the package and the number of crimps of the false twist yarn thus taken up simultaneously satisfy the following conditions (1), (2) and (3):

(1) $70 \leqq \text{hardness} \leqq 90$ (2) $0.6\ \text{g/cm}^3 \leqq \text{winding density} \leqq 1.0\ \text{g/cm}^3$ (3) $\text{hardness} \times \text{the number of crimps} \geqq 520$ The package of the present invention maintains a favorable package shape and is excellent in unwinding property, whereby a high-quality knit or woven fabric is obtainable.

3 Claims, No Drawings

PACKAGE FOR TAKING UP FALSE TWIST YARNS

TECHNICAL FIELD

The present invention relates to a package of a false twist yarn composed of polyester type fibers, particularly to a package of a false twist yarn composed of polytrimethylene terephtahlate fibers, capable of retaining favorable winding package shape, low in unwinding tension and a variation thereof, and capable of providing a high-quality knit or woven fabric.

BACKGROUND ART

As polyester type fibers excellent in elastic recovery and suitably used as material for a stretch fabric, a false twist yarn of polyester type fibers has been proposed, for example, in Japanese Unexamined Patent Publication No. 9-78373, which polymer component is mainly composed of polytrimethylene terephthalate.

When this false twist yarn is wound onto a package under winding conditions usually adopted for taking up a false twist yarn of polyethylene terephthalate type polyester fibers or nylon fibers, however, yarn shrinkage occurs in the package during the winding operation as the amount of wound yarn increases, and the hardness of the package becomes too high, whereby the package may collapse a paper tube or a package diameter becomes larger at the both ends of the paper tube to result in a high-selvage package shape. This causes the generation of single filament breakage, a difference in crimp characteristics between inner and outer portions of the package, and a change with time of the crimp characteristics, resulting in quality deterioration in knit or woven fabrics.

It is possible to avoid the collapse of paper tube and the generation of high-selvage package shape by lowering the winding tension so that the package hardness and the winding density become lower. However, a false twist yarn of polytrimethylene terephthalate fibers has a remarkable tendency to generate a single-filament snarl (a looped part of the filament individually twisted to jut out from a yarn surface). This tendency is accelerated as the winding tension is lowered to result in a failure to unwind the false twist yarn from the package due to entanglement of the single-filament snarls. This phenomenon is particularly significant in a single-heater type false twist yarn.

As another method for preventing the paper tube from collapsing, a double paper tube may be used for carrying out a high hardness and high density winding. While this countermeasure is effective for solving the problem relating to the collapse of the paper tube, the high-selvage package shape of the false twist yarn of polytrimethylene terephthalate fibers is not avoidable. Further, the false twist yarn of polytrimethylene terephthalate fibers, particularly that of a single-heater type, is characterized in a larger residual torque than the false twist yarn of polyethylene terephthalate type polyester fibers. The residual torque becomes larger as the package is wound harder to result in the generation of snailing during unwinding, which lowers the knitting/weaving ability, exaggerates the bias deformation of knit/woven fabric, develops a surface undulation in the knit/woven fabric, or generates a hard crepe.

DISCLOSURE OF THE INVENTION

An object of the present invention is to solve the above-mentioned drawbacks and provide a package of a false twist yarn composed of polytrimethylene terephtahlate fibers, capable of retaining favorable winding package shape, smooth in unwinding operation and capable of providing a high-quality knit or woven fabric.

The present inventors have diligently studied a package of a false twist yarn composed of polytrimethylene terephtahlate fibers, and have found that the object is achievable by a yarn package having certain specifications, to complete the present invention.

That is, the present invention relates to a package of a false twist yarn composed of polytrimethylene terephthalate fibers, characterized in that the hardness and the winding density of the package and the number of crimps of the false twist yarn thus taken up simultaneously satisfy the following conditions (1), (2) and (3):

(1) $70 \leqq \text{hardness} \leqq 90$ (2) $0.6\ \text{g/cm}^3 \leqq \text{winding density} \leqq 1.0\ \text{g/cm}^3$ (3) $\text{hardness} \times \text{the number of crimps} \geqq 520$ The present invention will be described in more detail below.

Polytrimethylene terephthalate fiber is a polyester fiber containing trimethylene terephthalate as a main repeated unit wherein the trimethylene terephthalate unit is contained at a ratio of approximately 50 mol % or more, preferably 70 mol % or more, more preferably 80 mol % or more, further more preferably 90 mol % or more. Accordingly, this fiber includes polytrimethylene terephthalate containing, as a third component, another acidic component and/or glycolic component of a total amount of less than approximately 50 mol %, preferably less than 30 mol %, more preferably less than 20 mol %, further more preferably less than 10 mol %.

The polytrimethylene terephthalate is synthesized by bonding terephthalic acid or functional derivative thereof with trimethylene glycol or functional derivative thereof in the presence of catalyst under a suitable reactive condition. In this synthesis process, one kind or more of third component may be added to be copolymerized polyester or, after individually preparing a polyester other than polytrimethylene terephthalate such as polyethylene terephthalate; nylon; and polytrimethylene terephthalate, they may be blended together or spun to be a composite fiber (a sheath-core type fiber or a side-by-side type fiber).

The third component to be added includes aliphatic dicarbonic acid (oxalic acid, adipic acid or the like), cycloaliphatic dicarbonic acid (cyclohexane dicarbonic acid or the like), aromatic dicarbonic acid (isophthalic acid, sodium sulfoisophthalic acid or the like), aliphatic glycol, (ethylene glycol, 1,2-propylene glycol, tetramethylene glycol, or the like), cycloaliphatic glycol (cyclohexane dimethanol or the like), aliphatic glycol containing aromatic group (1,4-bis(β-hydoxyethoxy) benzene or the like), polyether glycol (polyethylene glycol, polypropylene glycol or the like), aliphatic oxycarbonic acid (ω-oxycapronic acid or the like) or aromatic oxycarbonic acid (p-oxybenzoic acid or the like). Also, compounds having one or three or more ester-forming functional groups (benzoic acid, glycerin or the like) may be used provided the polymer is maintained substantially in a linear range.

The polytrimethylene terephthalate may be added with a delustering agent such as titanium dioxide, a stabilizing agent such as phosphoric acid, an ultraviolet absorbing agent such as a derivative of hydroxybenzophenone, a crystal neucleator, such as talc, a lubricant such as aerozil, an antioxidant such as a derivative of hindered phenol, a flame retardant, an antistatic agent, a pigment, a fluorescent whitener, an infrared absorbing agent, and an antifoaming agent.

The polytrimethylene terephthalate fiber used in the present invention may be spun by either a normal method wherein, after an undrawn yarn has been obtained at a takeup speed of approximately 1500 m/min, the yarn is drawn at a draw ratio in a range from approximately 2 to 3.5 times, a spin-draw method wherein a spinning process is directly combined with a drawing process, a spin-takeup method wherein a yarn spun from a spinning machine is directly taken up at a high speed of 5000 m/min or more.

The configuration of the fiber may be either uniform or irregular in thickness in the lengthwise direction, and a cross-sectional shape thereof may be circular, triangular, an L-shape, a T-shape, a Y-shape, a W-shape, an eight-lobe shape, a flat shape and a dog-bone shape. Also, the fiber may be hollow or even an indefinite shape.

The false twist may be imparted by any conventional false twisting method such as a pin type, a friction type, a nip belt type, an air-twisting type or others. Also, either a single-heater system or a double-heater system may be adopted. Further, the false twist yarn may be obtained by draw-texturing a pre-oriented yarn (POY).

A hardness of the yarn package must be 70 or more and 90 or less, preferably 75 or more and 90 or less. A winding density of the yarn package must be 0.6 g/cm$^3$ or more and 1.0 g/cm$^3$ or less, preferably 0.65 g/cm$^3$ or more and 0.95 g/cm$^3$ or less.

If the hardness is less than 70 or the winding density is less than 0.6 g/cm$^3$, a traverse miss may occur or package deformation may occur, during transportation, due to vibration. Single-filament snarls are often generated particularly in the single-heater type false twist yarn, which causes an excessive peak tension during the unwinding of the false twist yarn from the package due to the entanglement of the single-filament snarls with each other and, in extreme cases, results in yarn breakage to interrupt the unwinding operation. Or, even if the yarn breakage does not occur, the fluctuation of unwinding tension adversely influences the knitting ability, warping ability and weaving ability.

Contrarily, if the hardness exceeds 90 or the winding density exceeds 1.0 g/cm$^3$, the collapse of a paper tube would occur even if a double paper tube is used, and thus a suitable package shape could not be maintained. Also, a so-called high-selvage phenomenon, wherein the diameter of the package at both ends becomes larger, occurs and single-filament breakage is liable to occur. In particular, since the single-heater type false twist yarn has a large residual torque, snailing occurs during the unwinding operation to result in the deterioration of knitting ability and weaving ability, and the knit or woven fabric formed thereof has a tendency to bias deformation, or generates undulation or a hard crepe on the surface thereof. In addition, since the difference in crimp characteristic between inner and outer portions of the package and the change thereof with time become larger, the quality of the knit or woven fabric is degraded.

Unlike a false twist yarn of polyethylene terephthalate type polyester fibers, a package of a false twist yarn of polytrimethylene terephthalate fibers is liable to harden more with time, as it has been wound harder, whereby the hardness and the winding density are preferably as small as possible unless the unwinding operation is disturbed.

The number of crimps is an indication representing a degree of crimp development when the yarn is unwound from the package. Particularly in the single-heater type false twist yarn, crimps are not well developed when the number of crimps is small but are rich in single-filament snarls inherent to the false twist yarn of polytrimethylene terephthalate which worsens the unwinding operation. Contrarily, if the number of crimps is larger, the single-filament snarls are fewer which facilitates the unwinding.

However, since the unwinding property of the false twist yarn of polytrimethylene terephthalate fibers is related also to the package hardness and winding density, the present inventors have diligently studied and found that the unwinding is facilitated if the following coefficient is within a certain range.

That is, a value of a hardness of the package×the number of crimps must be 520 or more, preferably 650 or more. If the value is less than 520, an extremely large number of single-filament snarls develop and are entangled with each other during the unwinding of the false twist yarn, resulting in problems in that the unwinding tension and the fluctuation thereof become excessively large to deteriorate the unwinding property and worsen the knitting ability, warping ability and weaving ability.

The number of single-filament snarls is preferably 3.5/cm or less, more preferably 2.5/cm. The false twist yarn of polytrimethylene terephthalate fibers and, in particular, of a single-heater type, is extremely liable to generate single-filament snarls in comparison with the single-heater type false twist yarn of polyethylene terephthalate type polyester fibers. If the number of single-filament snarls exceeds 3.5/cm, the unwinding operation of the false twist yarn from the package tends to be disturbed due to the entanglement of the single-filament snarls.

The generation of single-filament snarls largely varies in accordance with the winding conditions, which is especially true in the single-heater type false twist yarn. This is because that the false twist yarn of polytrimethylene terephthalate fibers has a more apparent crimp compared with the false twist yarn of polyethylene terephthalate type polyester fibers, and the development of apparent crimps thereof largely varies, even if the false twist condition is constantly maintained, in accordance with yarn tensions between a delivery roller and a winder after the false twisting. If the yarn tension is relatively low between the delivery roller and the winder, the apparent crimps do not develop much, whereby the number of crimps is less and the number of single-filament snarls is larger. The higher the yarn tension, the more the developed the apparent crimp. Thus, the number of crimps increases and that of the single-filament snarls decreases.

To obtain a yarn package having fewer single-filament snarls and to facilitate the unwinding operation, it is necessary to form the package with a winding tension larger than a certain level. Concretely, the winding tension periodically varies in correspondence with the reciprocation of a traverse guide. The average winding tension per unit thickness of the false twist yarn is preferably 0.05 cN/dtex or more. If apparent crimps in the single-heater type false twist yarn may be developed by imparting a suitable tension thereto at a location between the delivery roller and the winder without heating the same by, for example, a second heater, it is possible to further reduce the winding tension in the winder.

To regulate the package hardness, the winding density, the number of crimps and the number of single-filament snarls to proper values, the average winding tension is preferably 0.05 cN/dtex or more and 0.22 cN/dtex or less. In this regard, even though the package has a favorable unwinding property, the knitting ability or weaving ability might deteriorate if the residual torque is excessively large because of the generation of snailing during the unwinding operation. The residual torque also causes the bias deformation of knit or woven fabric as well as the generation of undulation or hard crepe on the surface thereof. Accordingly, the residual torque is preferably 150 turns/m or less. If the residual torque is 150 turns/m, there is no problem in the generation of snailing and in the quality level of a knit or woven fabric surface. To have the false twist yarn exhibit a residual torque of 150 turns/m or less, the average winding tension is preferably 0.09 cN/dtex or less.

A winding angle may be suitably selected so that the form-retaining property or the unwinding property is favorably maintained and is, concretely, 10 degrees or more and 18 degrees or less.

Generally speaking, to obtain a package of a false twist yarn composed of polyethylene terephthalate type polyester fibers or polyamide fibers having no problems in an unwinding property and a form-retaining property, the average winding tension is preferably in a range from 0.13 to 0.18 cN/dtex. Contrarily, a proper average winding tension for winding the false twist yarn of polytrimethylene terephthalate fibers is apparently lower. It is thought that this is because the polytrimethylene terephthalate fiber is shrunk in the false twisting process after being substantially stretched in the twisting zone because of its high elastic recovery. However, it is assumed that this shrinkage does not instantaneously occur immediately after the departure of the yarn from the false-twisting zone or immediately before entering the winding process, but continues while the yarn is being taken up on the package and even after the package has been completed. Therefore, it is necessary to wind the yarn on the package at an extremely low tension so that room is provided for yarn shrinkage within the package.

Also, a reason why the package formed at a high winding tension is further hardened with time is thought to be that the room for absorbing the yarn shrinkage is smaller and that the shrinkage gradually progresses over a long time. Since the shrinkage is almost finished in a package formed at a low winding tension, when the package has completed, the package is prevented from becoming harder with time.

While a temperature of a false-twisting heater may be optionally selected in accordance with the target crimp characteristics, it is preferably determined, in general, so that a yarn temperature becomes 100° C. or higher and 200° C. or lower, preferably 120° C. or higher and 180° C. or lower, more preferably 130° C. or higher and 170° C. or lower immediately after exiting a first heater. A crimp extensibility of the single-heater type false twist yarn is 100% or more and 300% or less, and a crimp modulus of elasticity is preferably 80% or more.

If necessary, a double-heater type false twist yarn may be used, which is heat-set through a second heater. A temperature of the second heater is 100° C. or higher and 210° C. or lower, preferably in a range from 30° C. lower to 50° C. higher than the yarn temperature immediately after exiting the first heater. An overfeed ratio in the second heater (a second overfeed ratio) is preferably +3% or more and +30% or less. The crimp extensibility of the double-heater type false twist yarn is preferably 5% or more and 100% or less. Since the single-filament snarl or the residual torque reduces, which is significantly large in the single-heater type false twist yarn, as the second heater temperature or the second overfeed ratio becomes higher, it is possible to maintain the unwinding property at a relatively favorable level if a package hardness and a winding density are properly selected.

In this regard, the crimp extensibility and the crimp modulus of elasticity are measured in accordance with JIS-L-1090; a crimp extensibility test (method A) after a test piece has been heat-treated under a load of $2.6\times10^{-4}$ cN/dtex at 90° C. for 15 minutes and left a whole day and night.

The number of false twists T may be in a range usually used for false-twisting polyethylene terephthalate type polyester fibers, which is calculated by the following equation wherein K is a false twist coefficient preferably in a range from 18500 to 37000 and a favorable number of false twists is determined in accordance with thicknesses of a false twist yarn:

$$T=K/(\text{dtex of false twist yarn})^{0.5}$$

A false twist yarn package in the present invention includes those obtained by known composite false twisting methods, such as a simultaneous false twisting, a phase difference false twisting, or an elongation difference false twisting of polytrimethylene terephthalate fiber yarn and another fiber yarn; and those obtained by interlacing the false twist yarns of the present invention.

BEST MODES FOR CARRYING OUT THE INVENTION

The present invention will be described below, in more concrete terms, and with reference to the preferred embodiments, but should not be limited thereto.

Estimations, measurements or others are as follows:

(1) Winding tension

A yarn tension was measured immediately before a winding roller by a Check Master CM-50FR manufactured by KANAI KOKI and an average value was obtained therefrom.

(2) Unwinding ability

A knitting operation was carried out on a circular knitting machine (22 G/2.54 cm) manufactured by TOHEI KIKAI with a false twist yarn unwound from a package at a speed of 150 m/min. An unwinding tension was measured by a tension meter HS-4000 Model manufactured by EIKO SOKKI and recorded on a recorder, from which an average unwinding tension, an amplitude of the unwinding tension, an extraordinary peak tension due to the entanglement of single-filament snarls, and the generation of snailing during the unwinding operation were estimated.

(3) Hardness

A spring type hardness tester (Ascar rubber hardness tester C type manufactured by KOBUNSHI KEIKI K. K.) was used in accordance with JIS-K-6301; Method for testing physical properties for vulcanized rubber. Hardness was measured at two points in a central portion and at two points in each end portion; six points as a whole; and an average value was determined therefrom.

(4) Winding density

A weight of a yarn wound in a package was divided by a volume of the package geometrically calculated from an outer diameter, a winding width of the package and an outer diameter of a paper tube to result in the winding density.

(5) Number of crimps

A filament of a false twist yarn was picked up from a package while taking care not to stretch crimps. A total number of peaks and valleys of crimps was counted in a 25 mm length of the filament applied with a load of $1.764\times10^{-3}$ cN/dtex, and divided by 2. An average value of ten tests was obtained and converted to the number of crimps/cm.

(6) Number of single-filament snarls

A false twist yarn was picked up from a package while taking care not to stretch crimps, and an enlarged photograph of a side view thereof was taken while applying a load of $1.764\times10^{-3}$ cN/dtex thereto. Portions of the yarn from which a twisted filament loop juts out from the yarn surface were counted in this photograph as single-filament snarls. This measurement was carried out on a yarn length of 75 mm. An average value was obtained from the five measurements, and converted to the number of single-filament snarls per 1 cm.

(7) Residual torque

A false yarn was picked up as a test piece from a package while taking care not to apply torque. A test piece was hung on a hook so as to adjust each end thereof, and an initial load of $8.82\times10^{-2}$ cN/dtex was applied at a point at a distance of more than 1 m from the hook. Under this load, another load of $2.205\times10^{-2}$ cN/dtex was applied at a point at a distance of 1 m, and then the initial load was released. When the lower end of the two yarns was freely released, they rotated to be twisted together. After the rotation has ceased, the number of twists was measured by a twist counter. The measured value was divided by 2 and represented by turns/m. An average value of five measurements was used as the residual torque.

(8) Elastic recovery at 10% elongation

A test piece was applied with an initial load of $8.82\times10^{-2}$ cN/dtex and stretched at a constant rate of 20%/min. Upon reaching the elongation of 10%, the test piece was shrunk at the same rate but in the opposite direction to result in a stress-strain curve. In this curve, a point was obtained in the shrinking course at which a stress is lowered to the initial load of $8.82\times10^{-2}$ cN/dtex. From a residual elongation L at this point, the elastic recovery was calculated by the following equation:

$$\text{Elastic recovery at 10\% elongation}=[(10-L)/10]\times100\ (\%)$$

(9) ηsp/c

Polymer was dissolved in o-chlorophenol at 90° C. to have a concentration of 1 g/dl. The obtained solution was transferred to an Ostwald viscometer in which the measurement is carried out at 35° C. From the result, ηsp/c=was calculated by the following equation:

$$\eta sp/c=[(T/T0)-1]/C$$

wherein

T is a dropping time (seconds) of the sample solution;

T0 is a dropping time (seconds) of the solvent; and

C is a concentration (g/dl) of the solution.

EXAMPLE 1

Polytrimethylene terephthalate having an ηsp/c of 0.8 was spun at a spinning temperature of 265° C. and a spinning speed of 1200 m/min to obtain an undrawn yarn which was then drawn at a hot roll temperature of 60° C., a hot plate temperature of 140° C., a draw ratio of three times and a drawing speed of 800 m/min to obtain a drawn yarn of 84 dtex/24f. Strength, elongation, elastic modulus and elastic recovery at 10% elongation were 3.4 cN/dtex, 42%, 23 cN/dtex and 98%, respectively.

The resultant drawn yarn was false-twisted by a pin type false twisting machine IVF 338 manufactured by ISHIKAWA SEISAKUSHO, initially through a first heater at a yarn speed of 190 m/min, a false-twist number of 3230 T/m, an first overfeed ratio of −1% and a first heater temperature of 170° C., then through a second heater zone at a second heater overfeed ratio of ±0% and a second heater temperature of normal temperature to obtain a false twist yarn. The false twist yarn was taken up to form a package of a weight of 1 kg at a winding feed ratio of +4.0% and a winding angle of 12 degrees.

In this regard, the first overfeed ratio is defined by the following equation:

$$[(\text{peripheral speed of first feed roller}-\text{peripheral speed of second feed roller})/\text{peripheral speed of second feed roller}]\times100;$$

the second overfeed ratio is defined by the following equation:

$$[(\text{peripheral speed of second feed roller}-\text{peripheral speed of third feed roller})/\text{peripheral speed of second roller}]\times100;$$

the winding feed ratio is defined by the following equation:

$$[(\text{peripheral speed of second feed roller}-\text{peripheral speed of winder roller})/\text{peripheral speed of second feed roller}]\times100.$$

The resultant false twist yarn had a crimp extensibility of 192% and a crimp modulus of elasticity of 88%. The number of single-filament snarls was 1.8/cm, and a residual torque was 142 turns/m.

A paper tube used for taking up a false twist yarn was formed of two 3 mm thick paper sheets laminated together to have an outer diameter of 75 mm and a width of 290 mm. The winding operation was carried out at an initial traverse width of 254 mm and an average winding tension of 0.07 cN/dtex. The resultant package had a hardness of 85.6, a winding density of 0.81 g/cm$^3$ and a hardness×the number of crimps of 826. The package shape was good and the package was free from single-filament breakage.

Also, the package shape, hardness and winding density were hardly changed even after the package was left in an environment of 25° C. and 65% RH for 24 hours. An average unwinding tension and the variance thereof were as small as 1.0 cN and 0.2 cN, respectively, and the unwinding property was so good that there was neither extraordinary peak tension caused by the entanglement of single-filaments nor the generation of snailing. The results are shown in Table 1.

EXAMPLE 2 to 5

The same polytrimethylene terephthalate drawn yarn as used in Example 1 was false-twisted under the same condition as in Example 1, and the false twist yarn was taken up under the same condition as in Example 1 to obtain a package, except that the second overfeed ratio and the winding feed ratio are changed as shown in Table 1. An average winding tension, a hardness, a winding density, a hardness×the number of snarls, a residual torque and the estimation of unwinding property of the resultant package were shown in Table 1.

Packages obtained by Examples 2, 3 and 5 was of a favorable package shape and free from single-filament breakage. Also, the hardness and winding density thereof hardly changed with time. While a package obtained by Example 4 had slightly high selvages, this is not so serious as to cause the generation of single-filament breakage.

Regarding the estimation of the unwinding property, in Examples 3, 4 and 5, the average unwinding tension was low and the variance in unwinding tension was small. Also, there was neither the generation of an extraordinary peak tension caused by the entanglement of single-filament snarls nor the generation of snailing which resulted in a favorable unwinding property. In Example 2, the average unwinding tension and the variance thereof were slightly larger, but not so serious as to cause a problem in the unwinding property. That is, there was neither the generation of an extraordinary peak tension caused by the entanglement of single-filament snarls nor the generation of snailing.

EXAMPLE 6

The same drawn yarn as used in Example 1 was false-twisted by a belt-nip type false twisting machine Mach 33H manufactured by MURATA KIKAI through a first heater at a yarn speed of 320 m/min, a belt intersecting angle of 110 degrees (the number of false twists of approximately 3200 T/m), a first overfeed ratio of ±0%, VR (belt speed/yarn speed) of 1.31 and a first heater temperature of 170° C. Then the yarn passed through a second heater zone at a normal temperature and a second overfeed ratio of +4.8% and was taken up, to form a package with a weight of 1 kg on the same paper tube as used in Example 1, at a winding feed ratio of +4.8% and a winding angle of 12 degrees.

The resultant false twist yarn had a crimp extensibility of 178% and a crimp modulus of elasticity of 86%. The number of single-filament snarls was 1.7/cm and a residual torque was 144 turns/m. An average winding tension was 0.08 cN/dtex, and the package had a hardness of the package of 85.5, a winding density of 0.82 g/cm$^3$ and a hardness×the number of crimps of 730.

A package shape was good and free from single-filament breakage. Also, the package shape, hardness and winding density hardly changed even after the package has been left for 24 hours. An average unwinding tension and the variance thereof were as small as 1.0 cN and 0.2 cN, respectively, and the unwinding property was so good that there was neither an extraordinary peak tension caused by the entanglement of single-filaments snarls nor the generation of snailing. The results are shown in Table 1.

Comparative Examples 1 to 3

The same polytrimethylene terephthalate drawn yarn as used in Example 1 was false-twisted under the same condition as in Example 1, and the false twist yarn was taken up under the same condition as in Example 1 to obtain a package, except that the second overfeed ratio and the winding feed ratio are changed as shown in Table 1. An average winding tension, a hardness, a winding density, a hardness×the number of snarls, a residual torque and the estimation of unwinding property of the resultant package are shown in Table 1.

A package obtained by Comparative Example 1 was low both in hardness and winding density because the average winding tension was excessively low, which is problematic in that a traverse miss occurs to deform the package. Also, since there were many single-filament snarls, yarn breakage often occurred during the unwinding operation to make a continuous unwinding operation impossible.

While a package obtained by Comparative example 2 had a proper hardness and winding density suitable for maintaining a favorable package shape, an average winding tension was as low as 0.04 cN/cm$^3$ and the hardness×the number of crimps was small, causing the generation of many single-filament snarls. Therefore, an average unwinding tension was high, the variance thereof was large, and an extraordinary peak tension was frequently generated, due to the entanglement of single-filament snarls, to deteriorate the unwinding property.

In Comparative example 3, an average winding tension was excessively high to increase the hardness and winding density of the package and cause the high-selvage package shape, which was problematic because of the generation of single-filament breakage. The hardness and winding density were higher after the package has been left for 24 hours. Also, since the residual torque was large, snailings were generated during the unwinding process.

TABLE 1

| | Example | | | | | | Comparative example | | |
|---|---|---|---|---|---|---|---|---|---|
| | 1 | 2 | 3 | 4 | 5 | 6 | 1 | 2 | 3 |
| False twisting machine | pin type | pin type | pin type | pin type | pin type | belt-nip type | pin type | pin type | pin type |
| Second overfeed ratio (%) | ±0 | ±0 | ±0 | ±0 | +3.7 | +4.8 | +8.5 | +6.3 | +0 |
| Winding overfeed ratio (%) | +4.0 | +5.5 | +3.6 | +3.2 | +3.7 | +4.8 | +8.5 | +6.3 | +2.8 |
| Average winding tension (cN/dtex) | 0.07 | 0.03 | 0.09 | 0.13 | 0.09 | 0.08 | 0.02 | 0.04 | 0.24 |
| Immediately after winding | | | | | | | | | |
| Hardness | 85.6 | 75.3 | 87.5 | 89.0 | 87.8 | 85.5 | 67.2 | 80.3 | 91.8 |
| Winding density (g/cm$^3$) | 0.81 | 0.67 | 0.89 | 0.94 | 0.86 | 0.82 | 0.54 | 0.68 | 1.07 |
| Hardness × number of crimps | 826 | 533 | 911 | 981 | 881 | 730 | 343 | 502 | 1157 |
| Number of snarls (/cm) | 1.8 | 2.5 | 1.1 | 0.8 | 1.9 | 1.7 | 7.3 | 4.1 | 0.7 |
| Residual torque | 142 | 121 | 148 | 159 | 145 | 144 | 72 | 95 | 175 |
| Package shape | good | good | good | somewhat high-selvage | good | good | traverse miss | good | high-selvage |
| After 24 hours | | | | | | | | | |
| Filament breakage | none | none | none | none | none | none | none | none | present |
| Hardness | 85.8 | 75.4 | 87.6 | 89.3 | 87.8 | 85.6 | 68.2 | 80.3 | 92.5 |
| Winding density (g/cm$^3$) | 0.82 | 0.68 | 0.91 | 0.96 | 0.87 | 0.82 | 0.54 | 0.68 | 1.10 |
| Package shape | good | good | good | somewhat high-selvage | good | good | traverse miss | good | high-selvage |
| Average unwinding tension (cN) | 1.0 | 2.9 | 1.0 | 1.0 | 1.0 | 1.0 | impossible to unwind | 8.8 | 1.0 |
| Amplitude of unwinding tension (cN) | ±0.2 | ±0.4 | ±0.2 | ±0.2 | ±0.2 | ±0.2 | | ±1.5 | 0.2 |

TABLE 1-continued

| | Example | | | | | | Comparative example | | |
|---|---|---|---|---|---|---|---|---|---|
| | 1 | 2 | 3 | 4 | 5 | 6 | 1 | 2 | 3 |
| Extraordinary peak tension | none | none | none | none | none | none | — | many | none |
| Generation of snailing | none | none | none | none | none | none | — | none | present |

Capability of Exploitation in Industry

A package of a false twist yarn composed of polytrimethylene terephtahlate fibers according to the present invention has a favorable unwinding property, that is, the unwinding tension is low and the variance thereof is small. A package has a stable shape invariable with time and is excellent in knitting ability and weaving ability. Thus, it is possible to obtain a high-quality knit/woven fabric from the package according to the present invention.

What is claimed is:

1. A package of a false twist yarn composed of polytrimethylene terephthalate fibers, characterized in that a hardness and a winding density of the package and the number of crimps of the false twist yarn thus taken up simultaneously satisfy the following conditions (1), (2) and (3):

(1) $70 \leqq \text{hardness} \leqq 90$ (2) $0.6\ \text{g/cm}^3 \leqq \text{winding density} \leqq 1.0\ \text{g/cm}^3$ (3) $\text{hardness} \times \text{the number of crimps} \geqq 520$.

2. A package of a false twist yarn, as defined by claim 1, characterized in that the number of single-filament snarls of the false twist yarn wound on the package is 3.5/cm or less.

3. A package of a false twist yarn, as defined by claim 2, characterized in that a residual torque of the false twist yarn wound on the package is 150 turns/m or less.

* * * * *